US011736864B2

(12) United States Patent
Yoon et al.

(10) Patent No.: US 11,736,864 B2
(45) Date of Patent: Aug. 22, 2023

(54) HEADPHONE STAND

(71) Applicants: Seok Won Yoon, Fresh Meadows, NY (US); Giuseppe Massara, Vicenza (IT)

(72) Inventors: Seok Won Yoon, Fresh Meadows, NY (US); Giuseppe Massara, Vicenza (IT)

(73) Assignee: ADVSOUND, INC., Fresh Meadows, NY (US)

( * ) Notice: Subject to any disclaimer, the term of this patent is extended or adjusted under 35 U.S.C. 154(b) by 0 days.

(21) Appl. No.: 17/565,052

(22) Filed: Dec. 29, 2021

(65) Prior Publication Data

US 2023/0209265 A1 Jun. 29, 2023

(51) Int. Cl.

| | |
|---|---|
| ***H04R 5/033*** | (2006.01) |
| ***H04R 1/02*** | (2006.01) |
| ***H04R 1/10*** | (2006.01) |

(52) U.S. Cl.

CPC ..... *H04R 5/0335* (2013.01); *H04R 1/026* (2013.01); *H04R 1/1008* (2013.01)

(58) Field of Classification Search

CPC ..... H04R 5/0335; H04R 1/026; H04R 1/1008
USPC ..... 381/374
See application file for complete search history.

(56) References Cited

U.S. PATENT DOCUMENTS

| | | | | |
|---|---|---|---|---|
| 7,938,372 | B2 * | 5/2011 | MacLeod | F16M 11/42 248/124.2 |
| D723,011 | S | 2/2015 | Symons | |
| D737,606 | S | 9/2015 | King | |
| D780,490 | S | 3/2017 | James et al. | |
| 10,425,715 | B2 | 9/2019 | Green | |
| 2005/0103957 | A1 * | 5/2005 | Chang | F16M 11/22 248/311.2 |

FOREIGN PATENT DOCUMENTS

| | | | |
|---|---|---|---|
| TW | M610109 | U | 4/2021 |

OTHER PUBLICATIONS

ProX Live Perfomance Gear, "Headphone Pole Stand For Cases 12" Shaft with Rotating Hook," <https://web.archive.org/web/20201001014021/https://www.proxdirect.com/products/view/Headphone-Pole-Stand-For-Cases-12-Shaft-with-Rotating-Hook-X-HH815/>, Oct. 1, 2020 (Year: 2020).*

Amazon.com, 6amLifestyle Dual Rotatable Headphone Stand Hanger Under Desk Clamp Headset Holder Aluminum Load up to 11lb Headset Stand Hanger Compatible with Universal Headphones, Black A-13BK, Date First Available: Jun. 9, 2020, https://www.amazon.com/6amLifestyle-Rotatabte-Compatible-Headphones-6A-13BK/dp/B089WDWP9/ref=sr_1_19?dchild=1&keywords=dual+headphone+stand&qid=1635877566&sr=8-19

Amazon.com, Brand: Fevilady, Headset Stand Detachable Wooden Headphone Headset Stand Double Sides Headset Display Stand Game Earphone Stand Headphone Stand, Date First Available:Feb. 26, 2021, https://www.amazon.com/Fevilady-Headset-Detachable-Headphone-Earphone/dp/B08T5WDQJW/ref=sr_1_227?dchild=1&keywords=dual%2Bheadphone%2Bstand&qid=1635877811&sr=8-227&th=1.

(Continued)

*Primary Examiner* — Sean H Nguyen
(74) *Attorney, Agent, or Firm* — Plager Schack LLP; Naomi Mann, Esq.; Mark H. Plager, Esq.

(57) ABSTRACT

According to various embodiments, disclosed is a headphone stand including a support base; a vertical beam coupled to the support base; and at least one arm rotationally coupled to the vertical beam, the arm being configured to rotate a full 360 degrees about the vertical beam. In some embodiments, the headphone stand may comprise two arms which rotate independently from one another.

19 Claims, 7 Drawing Sheets

(56) References Cited

OTHER PUBLICATIONS

Amazon.com, Headset Hanging Station, Headphone Dispaly Holder Station Dual Balance Bracket Headset Hanging Headphone Desk Hanger Hook Headphone Stand, Date First Available: Dec. 19, 2020, https://www.amazon.com/Headset-Hanging-Station-Headphone-Dispaly/dp/B08R1HRFWD/ref=sr_1_235?dchild=1&keywords=dual+headphone+stand&qid=1635877811&sr=8-235.

Amazon.com, Headphone Bracket Headset Holder Desktop Clip-on Headphone Rack Universal Dual Headphone Stand Metal Hanger Headphone Holder Portable and Rotatable Headphone Bracket Hook, Date First Available: Unknown, https://www.amazon.com/Headphone-Bracket-Universal-Portable-Rotatable/dp/B09HJQWRZJ/ref=sr_1_270?dchild=1&keywords=dual+headphone+stand&qid=1635877847&sr=8-270.

* cited by examiner

HEADPHONE STAND

BACKGROUND

The present disclosure relates generally to headphone storage systems, and more specifically to headphone stands.

Headphone use is increasing, both at work and in the home. Users of headphones may often desire to store headphones, and any accompanying accessories such as cables, in a designed location that prevents misplacement, keeps the headphones safe from damage, and avoids clutter. As such, there is a need for improved headphone storage systems.

SUMMARY

According to various embodiments, disclosed is a headphone stand which may comprise: a support base; a vertical beam coupled to the support base; and at least one arm rotationally coupled to the vertical beam, wherein the arm is configured to rotate a full 360 degrees about the vertical beam, wherein the support base is configured to support the headphone stand on a surface such as a desktop or tabletop, and wherein the arm is configured to support at least one set of headphones, headphone cable, and/or headphone jack above the surface on which the headphone stand is supported. In some embodiments, the headphone stand may comprise two arms which rotate independently from one another. In some embodiments, the arm(s) may include an end bracket extending vertically upwards from a top surface of the arm. In certain embodiments, the arm(s) may include silicone padding affixed to a top surface of the arm. In further embodiments, the silicone padding may be curved upwards with respect to the top surface of the arm. In some embodiments, the arm(s) may include at least one jack slot which is sized and structured to retain a headphone jack. In some further embodiments, the arm(s) may include three jack slots. In certain embodiments, the support base may include a platform and a boarder wall which extends upwards from the platform to create a well or tray that may be used for storage of various items. In some embodiments, the headphone stand is made from an iron alloy. In certain embodiments, the support base includes silicone pads affixed to its bottom surface.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
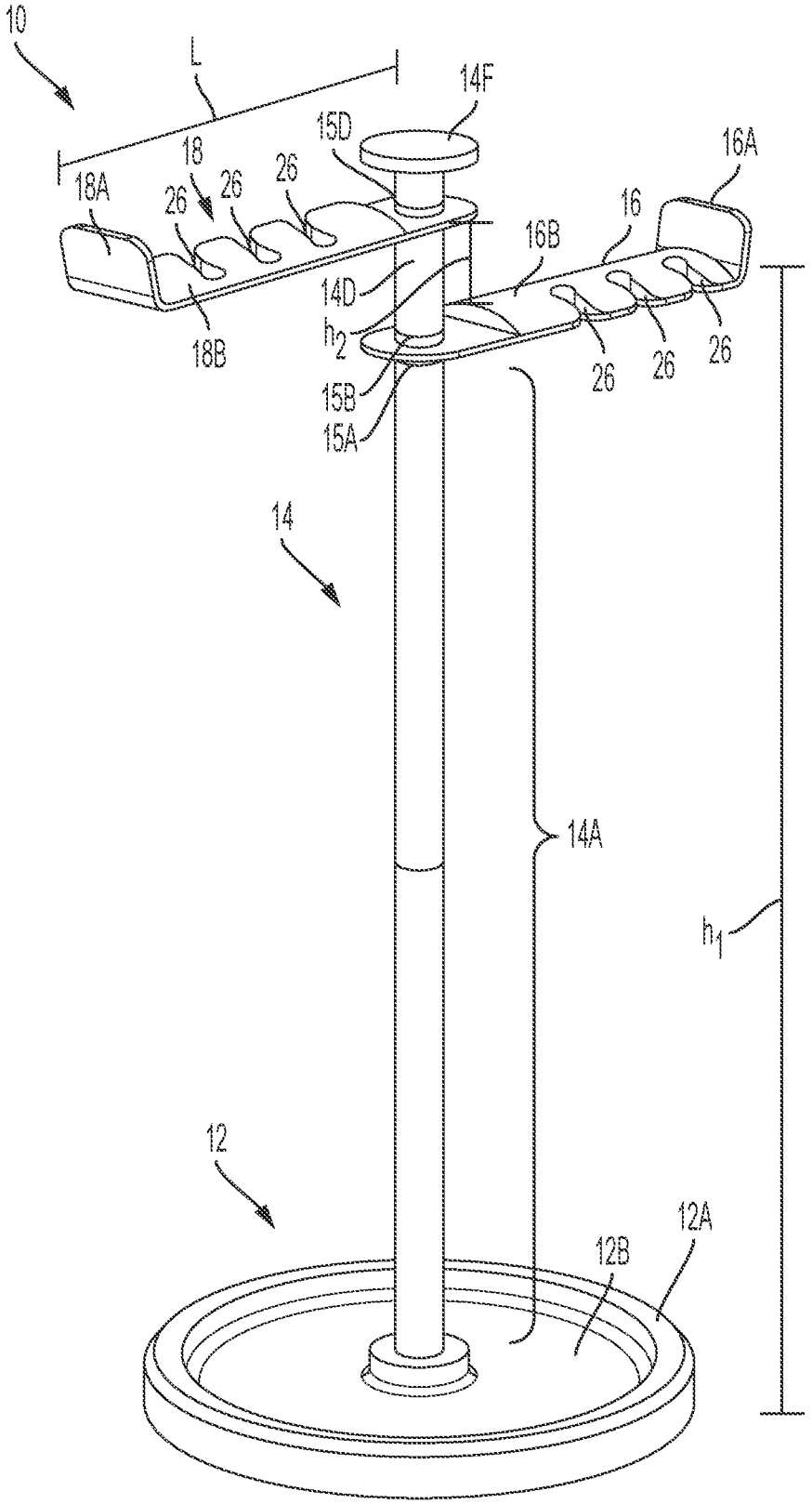
FIG. 1 is a perspective view of a headphone stand in accordance with certain embodiments.
Figure 2:
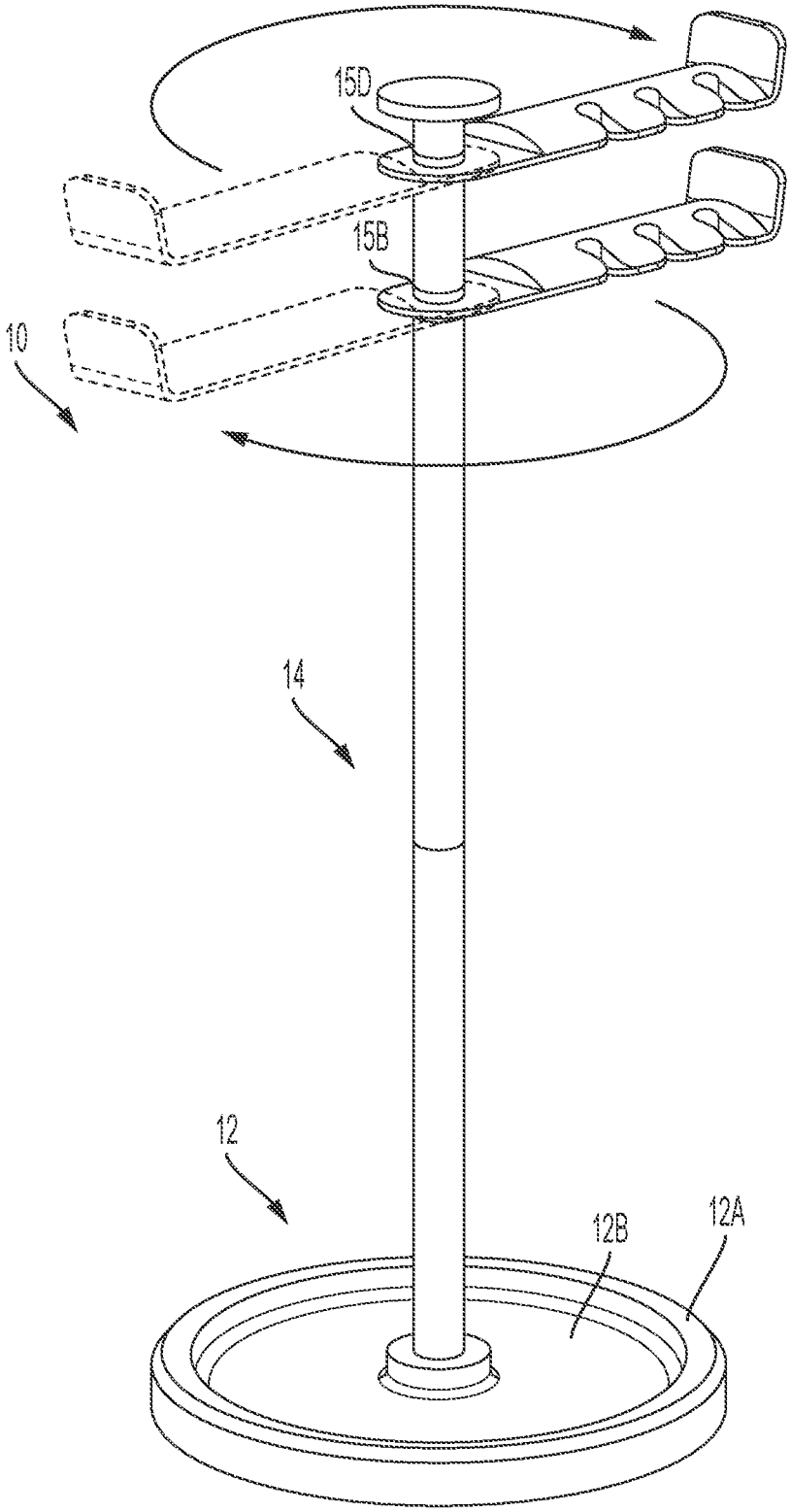
FIG. 2 illustrates motion of the arms of the headphone stand.

According to various embodiments as depicted in FIGS. 1-7, disclosed is a headphone stand 10 generally comprising a support base 12, a vertical beam 14 coupled to the support base, a first arm 16 rotationally coupled to the vertical beam, and a second arm 18 rotationally coupled to the vertical beam. In embodiments, headphone stand 10 is configured to sit on a surface such as a desk or tabletop and may be used to hold articles such as headphones 20, headphone cable(s) 22, and/or headphone jack(s) 24, as well as other small items as will be described.

In embodiments, first arm 16 and second arm 18 may be positioned above support base 12 to provide sufficient space for hanging headphones 20 and/or headphone cable(s) 22 above the surface on which headphone stand is situated. In some embodiments, first arm 16 and second arm 18 may be vertically offset from one another, and may each rotate independently from one another. In one embodiment, first arm 16 may be positioned at a height 'h1' of about 20 cm to about 30 cm, or at about 25.5 cm. Second arm 18 may be at a height 'h2' above first arm 16 of about 0.5 cm to about 4 cm, or about 2.5 cm above first arm 16. As such, headphone stand 10 may elevate headphones 20, headphone cable(s) 22, and/or headphone jack(s) 24 high above a desk or other surface, to leave the surface open and free from clutter. It shall be appreciated that first arm 16 and second arm 18 may be at various heights in alternate embodiments.

In embodiments, first arm 16 and second arm 18 may each be configured to rotate a full 360 degrees about vertical beam 14. Additionally, the rotation of first and second arms 16, 18, is under friction such that the arms maintain a fixed position after rotation and are prevented from uncontrolled swinging.

Figure 7:
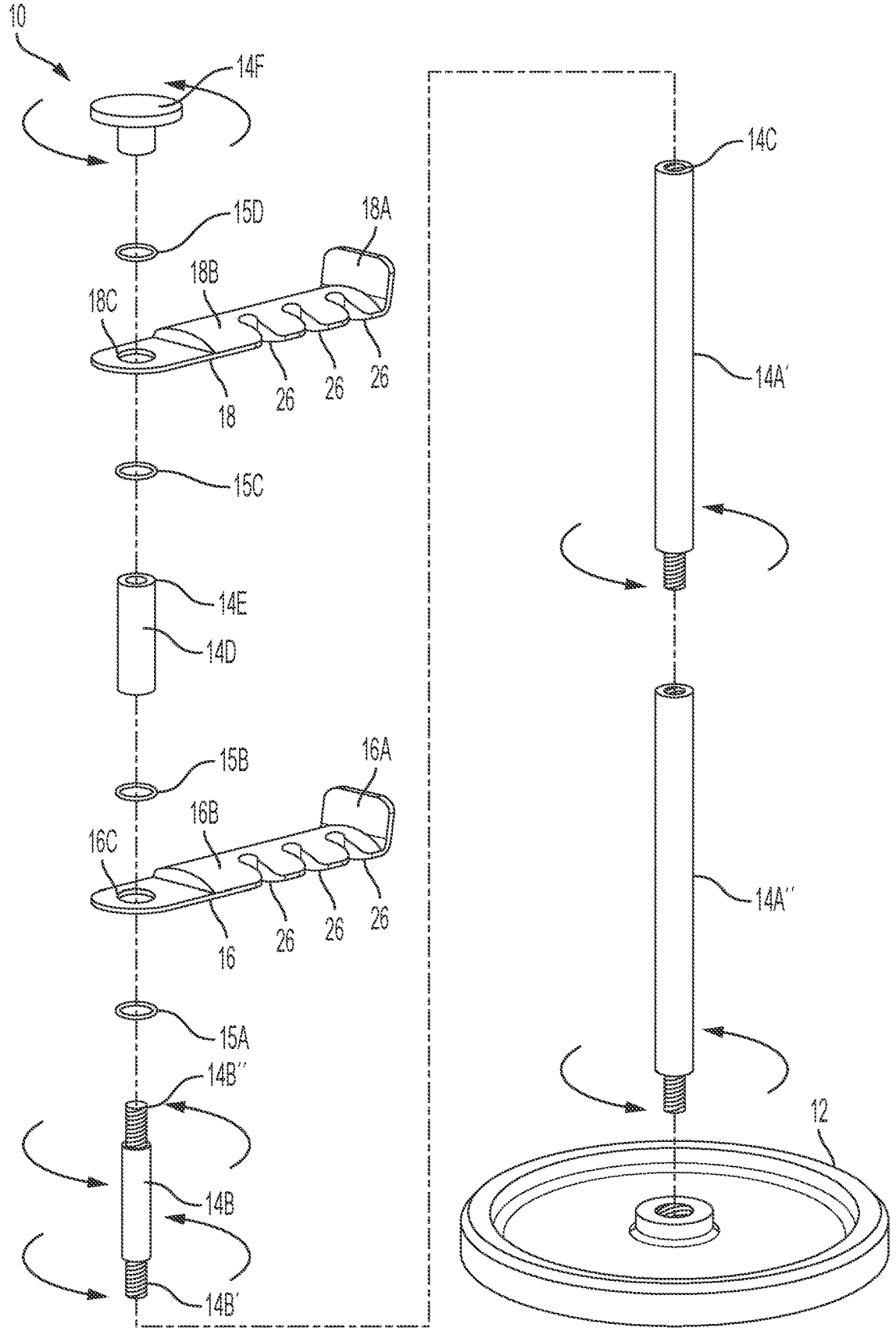
FIG. 7 is an exploded view of the headphone stand, according to certain embodiments.

In certain embodiments as best depicted in FIG. 7, vertical beam 14 may comprise a main beam 14A that supports a beam shaft 14B about which first arm 16 and second arm 18 may frictionally rotate, braced by O-rings 15A-15D. More specifically, beam shaft 14B includes an externally threaded bottom extension 14B' which may engage with internal threading within main beam 14A. Beam shaft 14B may therefore be screwed into main beam 14A at the top end 14C of main beam 14A to couple beam shaft 14B to main beam 14A. Additionally, the outer diameter of beam shaft 14B is smaller than that of main beam 14A such that top end 14C provides a main beam seat which extends radially outwards with respect to beam shaft 14B. A first O-ring 15A, engaged through beam shaft 14B, may be supported on top of the main beam seat. In embodiments, first arm 16 may be engaged through beam shaft 14B via an opening 16C within first arm 16 and may sit upon first O-ring 15A. A second O-ring 15B engaged through beam shaft 14B may sit on top of first arm 16 opposite first O-ring 15A. A tube 14D engaged through beam shaft 14B may sit upon second O-ring 15B. A top end 14E of tube 14D provides a tube seat which extends radially outwards with respect to beam shaft 14B. A third O-ring 15C engaged through beam shaft 14B may be supported on top of the tube seat. Additionally, second arm 18 engaged through beam shaft 14B via an opening 18C within second arm 18, may sit upon third O-ring 15C. A fourth O-ring 15D engaged through beam shaft 14B may sit on top of second arm 18 opposite third O-ring 15D. A top cap 14F including internal threading may be threadably coupled to an externally threaded top extension 14B" of beam shaft 14B to sandwich fourth O-ring 15D between top cap 14F and second arm 18 and to secure the assembly together.

As such, first arm 16 is rotationally coupled to beam shaft 14B and sandwiched between first and second O-rings 15A and 15B. Second arm 18 is likewise rotationally coupled to beam shaft 14B and sandwiched between third and fourth O-rings 15C and 15D. O-rings 15A-15D enable first and second arms 16 and 18 to frictionally rotate about vertical beam 14. In certain embodiments, O-rings 15A-15D may be made of hard plastic but are not limited to this option. It shall be appreciated that different frictional elements and configurations may be employed to provide frictional resistance to the rotational motion of the first and second arms in alternate embodiments.

In some embodiments, main beam 14A may comprise an upper main beam component 14A' and a lower main beam component 14A" which may threadably couple to one another as shown in the figures. Additionally, a lower end of main beam 14A may screw into support base 12. It shall be appreciated that main beam 14A may comprise a single component, or any number of multiple components in alternate embodiments. It shall be appreciated main beam 14A may be integral with support base 12 in alternate embodiments.

In embodiments, first arm 16 and second arm 18 may each support one or more sets of headphones 20 and/or headphone cable(s) 22 that may be hung from the arm(s). In some embodiments, first arm 16 and second arm 18 may each have a generally planar configuration. In further embodiments, first arm 16 and second arm 18 may each include an end bracket 16A, 18A, respectively, extending vertically upwards from a distal end of each arm. End brackets 16A, 18A prevent headphones 20 and/or headphone cable(s) 22 from sliding off the ends of the arms.

In certain embodiments, first arm 16 and second arm 18 may each have a length 'L' of between about 8 cm to about 15 cm, or about 10 cm. In some further embodiments, first arm 16 and second arm 18 may each include silicone padding 16B, 18B, affixed to each arm's respective top surface to provide a cushioned platform on which to support headphones 20 and/or headphone cable(s) 22. In some embodiments, silicone padding 16B, 18B, may be convex or curved upwards with respect to the top surface of each arm, providing an ergonomic design that prevents damage to the headphone band and preserves its shape. As such, headphones 20, and headphone cable(s) 22 including headphone jack(s) 24, may be hung from first arm 16 and/or second arm 18 for orderly storage. In some embodiments, multiple headphones 20 and/or cable(s) 22 may be stored on the headphone stand using one or both arms.

In some embodiments, first arm 16 and/or second arm 18 may include at least one jack slot 26 which is sized and structured to retain headphone jack(s) 24. In one embodiment, first arm 16 and second arm 18 may each include three slots 26. It shall be appreciated that first arm 16 and second arm 18 may include any number of slots 26 in alternate embodiments.

Figure 3:
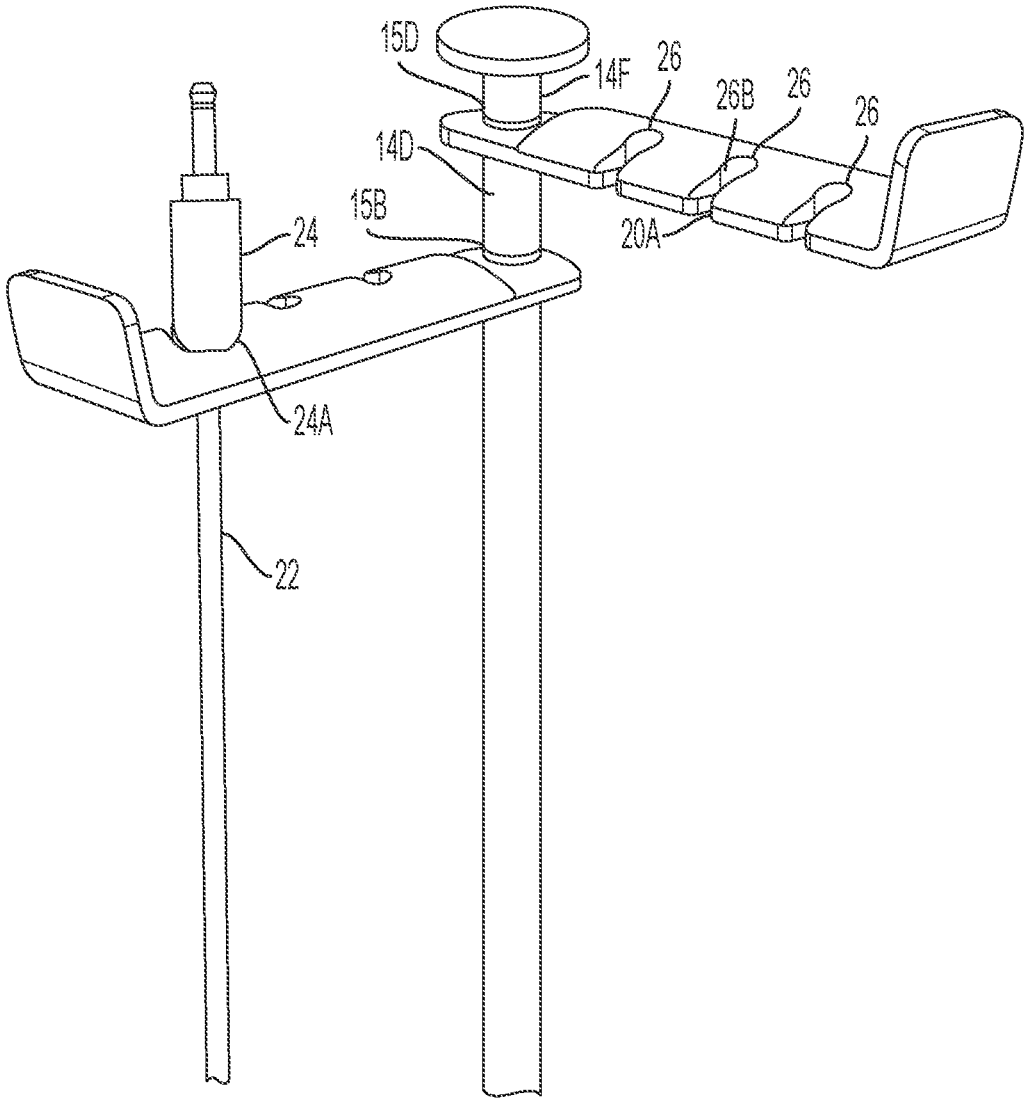
FIG. 3 illustrates a headphone jack retained in a slot of the headphone stand.
Figure 4:
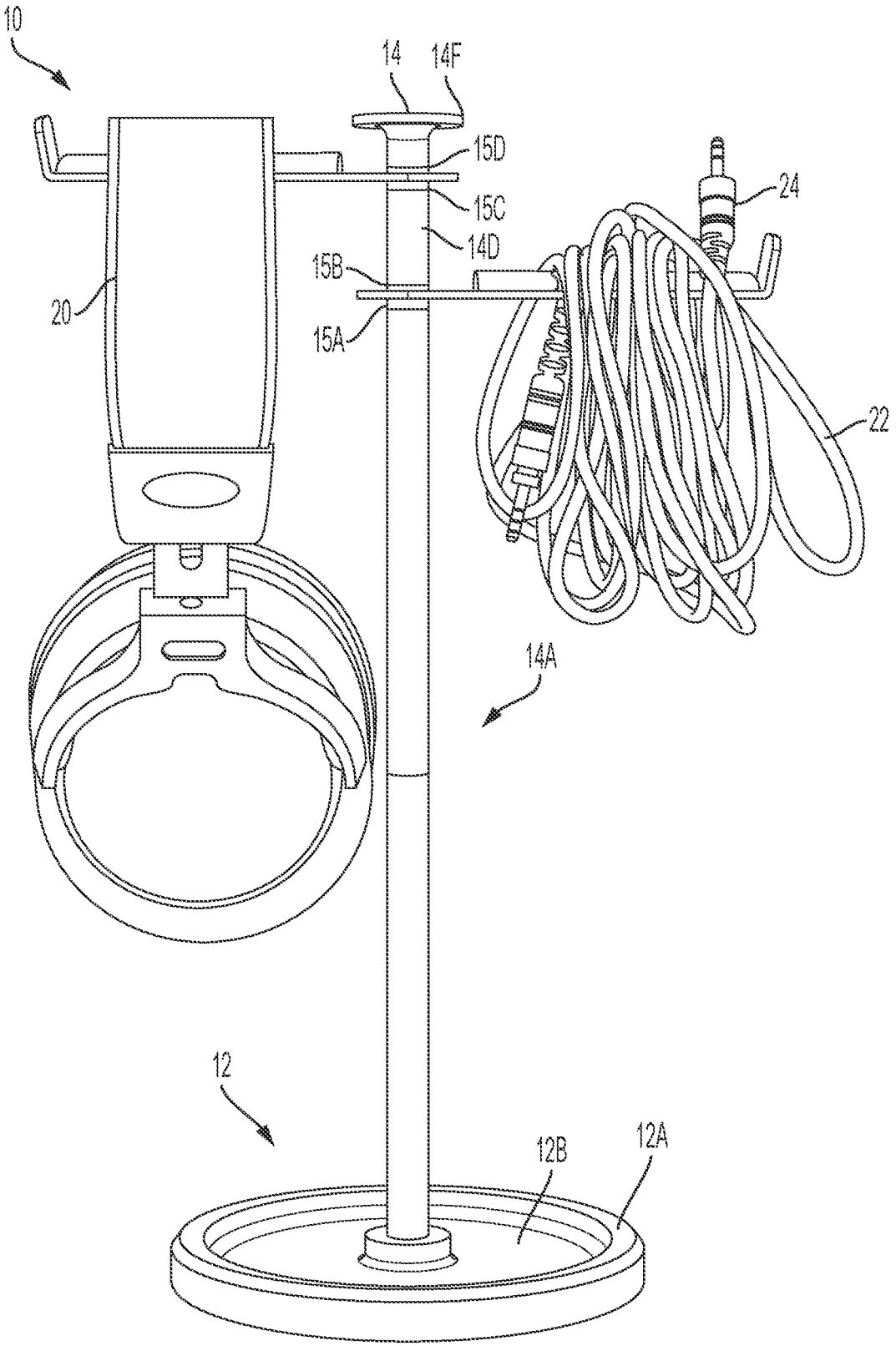
FIG. 4 shows the headphone stand in use for holding a set of headphones and a headphone cable, according to certain embodiments.
Figure 5:
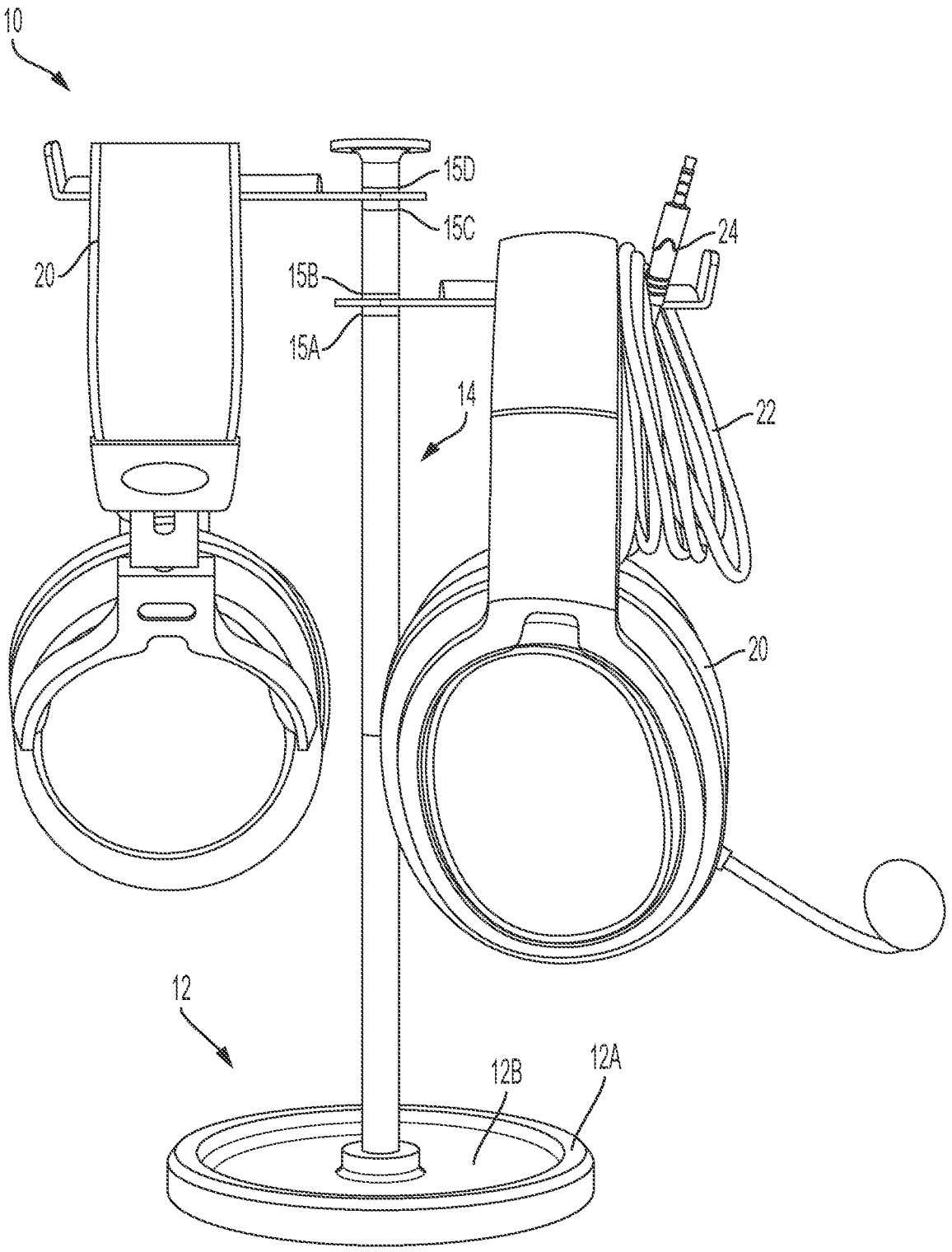
FIG. 5 shows the headphone stand in use for holding two sets of headphones and a headphone cable, according to certain embodiments.

In one embodiment, slot 26 may include a narrow entrance channel 26A that expands to a rounded portion 26B. Rounded portion 26B is configured to support headphone jack 24 at its base 24A and in an upright position, while cable 22 of headphone jack 24 may dangle below the slot as best depicted in FIG. 3. In some embodiments, rounded portion 26B may have a top opening which is wider than its bottom opening to enable headphone jack(s) 24 to be firmly held within slot 26 in an upright position.

In embodiments, support base 12 of headphone stand 10 may provide a tray for holding cable(s) 22, jack(s) 24, and/or other small items. In one embodiment, support base 12 may include a boarder wall 12A which extends upwards from a platform portion 12B of support base 12 to create a well in which various items may be stored. As such, support base 12 functions to support headphone stand 10, as well as providing added storage space.

In embodiments, headphone stand 10 is made of a heavy material, which weighs down support base 12 to create a sturdy and stable device which is safe from tipping over when supporting articles such as headphones 20, headphone cable(s) 22, and/or headphone jack(s) 24. In certain embodiments, headphone stand 10 may be made of a heavy-duty iron alloy but is not limited to this option. It shall be appreciated that headphone stand 10 may be made of various types of metals, non-metallic materials, or combination of materials in alternate embodiments.

Figure 6:
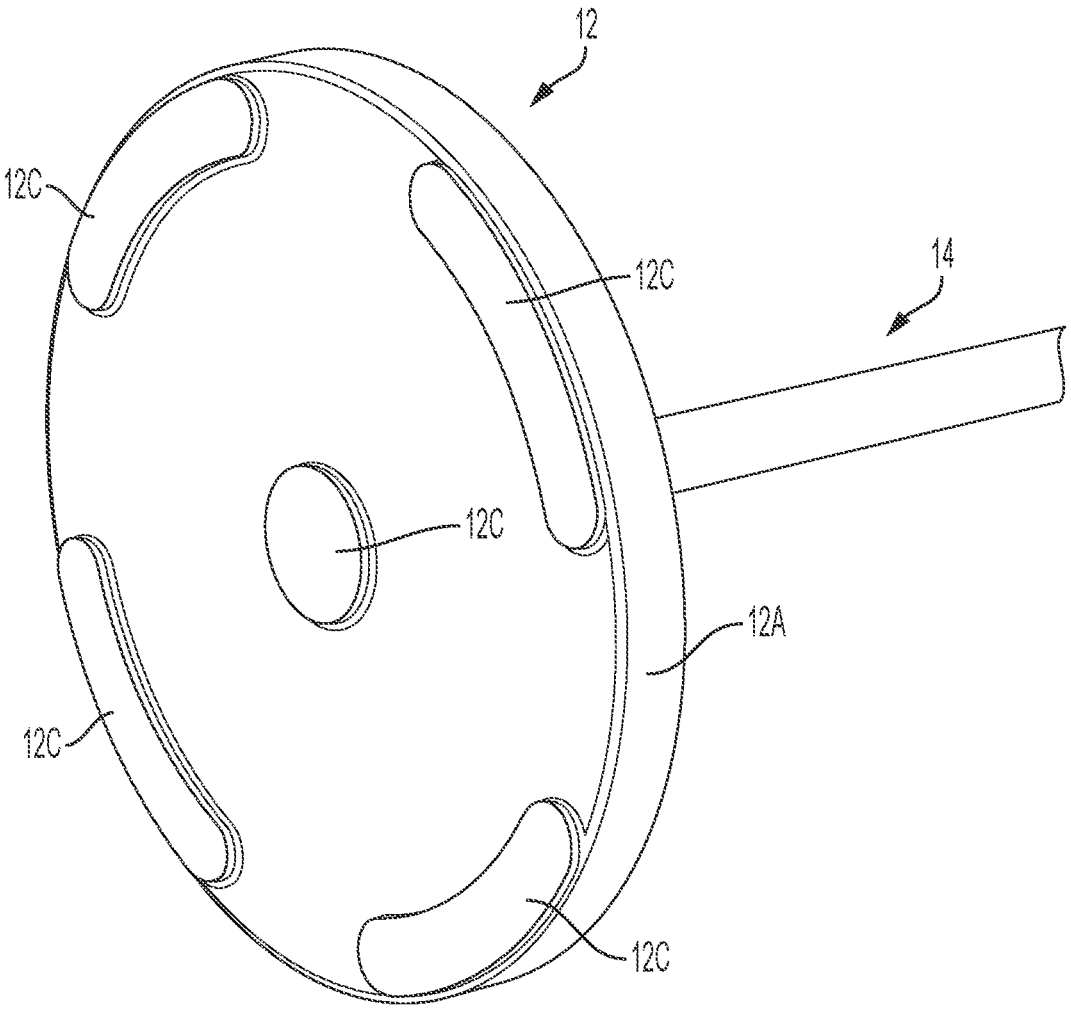
FIG. 6 is a perspective bottom view of the support base of the headphone stand.

In some embodiments as depicted in FIG. 6, support base 12 may comprise silicone contact pads 12C affixed to the bottom surface of the base, which prevent headphone stand 10 from slipping on a smooth surface such as a desk or tabletop. Thus, while the stand is portable, it is designed to stay in place due to its sturdy construction and/or adherence of the silicone contact pads 12C.

In certain embodiments, headphone stand 10 may comprise multiple parts which may be screwed together for easy assembly as shown in FIG. 7. It shall be appreciated that components of headphone stand 10 may comprise any number of parts that may be coupled to one another using various attachment mechanisms in alternate embodiments. It shall be appreciated that headphone stand 10 may be a single integral unit in alternate embodiments.

The disclosed subject matter provides an organized and compact headphone storage system that can be used to manage the storage of multiple headphones and headphone accessories, as well as other items. While the stand is portable, it is designed to stay in place on a table, desktop or other surface where it is situated, without needing to be permanently affixed to another object. The arms of the stand may be rotated a full 360 degrees to provide the user with full control of the angles on both arms. Additionally, the arms provide contoured surfaces for supporting headphones without damaging the headphone headband.

It shall be appreciated that the disclosed headphone stand 10 can have multiple configurations in different embodiments. It shall be appreciated that components of headphone stand 10 may comprise any alternative known materials in the field and be of any size and/or dimensions. It shall be appreciated that the components of headphone stand 10 may be manufactured and assembled using any known techniques in the field. Furthermore, the components of headphone stand 10 may be provided as an assembled and/or integral unit, or may be provided as a kit/assembly of parts according to alternate embodiments.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A headphone stand comprising:
a support base;
a vertical beam coupled to the support base; and
a first arm rotationally coupled to the vertical beam,
wherein the first arm is configured to rotate a full 360 degrees about said vertical beam,
wherein the support base is configured to support the headphone stand on a surface
wherein the first arm is configured to support at least one set of headphones, headphone cable, and/or headphone jack above the surface on which the headphone stand is supported,
wherein the vertical beam comprises a main beam and a beam shaft,
wherein said beam shaft is coupled to the main beam at a top end of the main beam, the beam shaft having an outer diameter which is smaller than an outer diameter of said main beam,
wherein the top end of the main beam provides a main beam seat that extends radially outwards with respect to said beam shaft,
wherein a first O-ring is engaged through said beam shaft and is supported on top of said main beam seat,
wherein said first arm is engaged through said beam shaft via an opening within said first arm, and wherein said first arm sits on top of said first O-ring,
wherein a second O-ring is engaged through said beam shaft and sits on top of the first arm, opposite said first O-ring, and
wherein the first arm is configured to frictionally rotate about said beam shaft, and is braced between the first O-ring and the second O-ring.

2. The headphone stand of claim 1, further comprising a second arm, and wherein the vertical beam further comprises a tube, and a top cap,
wherein said tube is engaged through said beam shaft and sits on top of said second O-ring, wherein a top end of the tube provides a tube seat which extends radially outwards with respect to the beam shaft,
wherein a third O-ring sits on top of said tube seat,
wherein the second arm is engaged through said beam shaft via an opening within said second arm, and wherein the second arm sits on top of said third O-ring,
wherein a fourth O-ring is engaged through said beam shaft and sits on top of the second arm, opposite said third O-ring,
wherein the top cap is coupled to the beam shaft to secure the assembly together, and wherein the fourth O-ring is captured between the top cap and the second arm, and
wherein the second arm is configured to frictionally rotate about said beam shaft, and is braced between the third O-ring and the forth O-ring.

3. The headphone stand of claim 2, wherein the beam shaft includes an externally treaded bottom extension which threadably engages with internal threading within the main beam to couple the beam shaft to the main beam.

4. The headphone stand of claim 2, wherein the beam shaft includes an externally threaded top extension which threadably engages with internal threading within the top cap to couple top cap to the beam shaft.

5. The headphone stand of claim 2, wherein the first O-ring, second O-ring, third O-ring, and fourth O-rings are made of hard plastic.

6. The headphone stand of claim 2, wherein the main beam comprises an upper main beam component and a lower main beam component configured to threadably couple to one another.

7. The headphone stand of claim 2, wherein a lower end of the main beam is configured to threadably couple to the support base.

8. A headphone stand comprising:
a support base;
a vertical beam coupled to the support base;
a first arm rotationally coupled to the vertical beam; and
a second arm rotationally coupled to the vertical beam and configured to rotate a full 360 degrees about said vertical beam,
wherein the first arm is configured to rotate a full 360 degrees about said vertical beam,
wherein the support base is configured to support the headphone stand on a surface
wherein the first arm is configured to support at least one set of headphones, headphone cable, and/or headphone jack above the surface on which the headphone stand is supported,
wherein the second arm is configured to support at least one set of headphones, headphone cable, and/or headphone jack above the surface on which the headphone stand is supported,
wherein the first arm and second arm are vertically offset from one another, and can rotate independently from one another.

9. The headphone stand of claim 8, wherein rotation of the first arm and the second arm is under friction such that the first arm and the second arm can each maintain a fixed position with respect to the vertical beam.

10. The headphone stand of claim 9, wherein the first arm and the second arm are each braced by a pair of O-rings.

11. The headphone stand of claim 10, wherein the first arm and the second arm each include:
silicone padding on a top surface of the arm, said silicon padding being curved upwards with respect to said top surface; and
at least one jack slot.

12. The headphone stand of claim 8, wherein first arm includes an end bracket extending vertically upwards from a top surface of the first arm, proximate a distal end of the first arm.

13. The headphone stand of claim 8, wherein the support base includes a platform and a boarder wall which extends upwards from the platform to create a well for storage of items.

14. The headphone stand of claim 8, wherein the headphone stand is made from an iron alloy.

15. The headphone stand of claim 8, wherein the support base includes silicone pads affixed to its bottom surface.

16. A headphone stand comprising:
a support base;
a vertical beam coupled to the support base; and
a first arm rotationally coupled to the vertical beam,
wherein the first arm is configured to rotate a full 360 degrees about said vertical beam, wherein the support base is configured to support the headphone stand on a surface wherein the first arm is configured to support at least one set of headphones, headphone cable, and/or headphone jack above the surface on which the headphone stand is supported, wherein first arm includes silicone padding affixed to a top surface of the first arm.

17. The headphone stand of claim 16, wherein the silicone padding of the first arm is curved upwards with respect to the top surface of the first arm.

18. The headphone stand of claim 16, wherein first arm includes at least one jack slot which is sized and structured to retain a headphone jack.

19. The headphone stand of claim 18, wherein the first arm includes three jack slots.

* * * * *